US006648490B2

(12) United States Patent
Klose

(10) Patent No.: US 6,648,490 B2
(45) Date of Patent: Nov. 18, 2003

(54) REFLECTOR LIGHTING FIXTURE, ESPECIALLY FOR IN-THE-FLOOR, IN-THE-WALL OR IN-THE-CEILING LIGHTING

(75) Inventor: Leonard Klose, Ludenscheid (DE)

(73) Assignee: Erco Leuchten GmbH, Ludenscheid (DE)

( * ) Notice: Subject to any disclaimer, the term of this patent is extended or adjusted under 35 U.S.C. 154(b) by 0 days.

(21) Appl. No.: 10/115,570

(22) Filed: Apr. 3, 2002

(65) Prior Publication Data

US 2002/0145870 A1 Oct. 10, 2002

(30) Foreign Application Priority Data

Apr. 4, 2001 (DE) ..... 101 16 742

(51) Int. Cl.[7] ..... F21V 19/02

(52) U.S. Cl. ..... 362/232; 362/285; 362/308; 362/372

(58) Field of Search ..... 362/146, 147, 362/153, 277, 280, 285, 289, 319, 364, 418, 232, 308, 330, 372, 430, 306, 512, 523, 429, 508, 800

(56) References Cited

U.S. PATENT DOCUMENTS

| | | | | |
|---|---|---|---|---|
| 1,335,727 A | * | 4/1920 | Eisele | 362/277 |
| 2,330,935 A | * | 10/1943 | Tuck | 362/147 |
| 4,677,533 A | * | 6/1987 | McDermott et al. | 362/240 |
| 5,988,836 A | | 11/1999 | Swarens | 362/364 |
| 6,109,766 A | | 8/2000 | Baliozian | 362/287 |

FOREIGN PATENT DOCUMENTS

| | | |
|---|---|---|
| DE | 299 06 806 | 10/2000 |
| DE | 200 19 334 U1 | 3/2001 |

* cited by examiner

*Primary Examiner*—Sandra O'Shea
*Assistant Examiner*—Bao Truong
(74) *Attorney, Agent, or Firm*—Herbert Dubno

(57) ABSTRACT

A parabolic reflector lighting fixture for use as an in-the-wall or in-the-floor or in-the-ceiling light has its lamp shiftable in a lumen plane perpendicular to the axis of symmetry of the parabolic reflector through the focal point. The parabolic reflector is limited to reflect light only between the intersection of this lumen plane and the reflector and between this intersection and the apex of the reflector.

24 Claims, 7 Drawing Sheets

REFLECTOR LIGHTING FIXTURE, ESPECIALLY FOR IN-THE-FLOOR, IN-THE-WALL OR IN-THE-CEILING LIGHTING

FIELD OF THE INVENTION

My present invention relates to a reflector-type lighting fixture for in the wall, in the floor or in the ceiling mounting and in which a parabolic reflector has, substantially at its focal point, a light source.

BACKGROUND OF THE INVENTION

A reflector-type lighting fixture for the purposes described has been discussed in principle in the Handbook for Lighting, "Handbuch fur Beleuchtung", 4th Edition, Verlag W. Girardet, Essen, page 107, 1975. In such fixtures, the light emerges from the open side and the reflector features refraction from the parabolic surface and derives from a lamp located generally at the focus of the parabola.

When parabolic reflector fixtures are used as in the floor lamps, the parabolic reflector is generally very flat and one of the characteristics of prior art reflector fixtures of this type is that the light can be blinding to an observer. The blinding effect of the light can be avoided by shielding the light source in a cup so that a direct line of sight between a person and the light source cannot occur.

A cone-type reflector for similar applications, i.e. adapted to be built into the floor, wall or ceiling can be found in the ERCO lighting program brochure (ERCO Leuchtenprogramm) published 1993/95, page 55. Here the reflector, a conical reflector which can have a socket or the like receiving the lamp itself and connected to a mounting, allows all purpose use of the lamp. This system permits a variation, by axial shifting of the reflector relative to the lamp, to vary the spreading of the illumination field.

Notwithstanding the fact that such lamps are widely used, it is still desirable to provide an in-the-wall, in-the-floor or in-the-ceiling reflector lamp which has a compact construction and can provide a blinding-free illumination.

OBJECTS OF THE INVENTION

It is, therefore, the principal object of the present invention to provide an improved lighting fixture which extends the principles of the prior art lighting fixtures described previously and is nevertheless more compact and generally flatter and capable of providing blinding-free illumination.

Another object of the invention is to provide a lighting fixture which can be more effectively used for in-the-floor, in-the-wall and in-the-ceiling illumination than fixtures known heretofore and which in spite of their flat and compact construction are free from the drawbacks previously mentioned of earlier fixtures of that type, i.e. free from the tendency to blinding the user or viewer.

SUMMARY OF THE INVENTION

These objects and others which will become apparent hereinafter are attained, in accordance with the invention in a lighting fixture of the type which comprises a parabolic reflector having an apex and a focus and wherein the parabolic reflector is effectively light transmissive only between the apex and a plane perpendicular to the axis of the parabola connecting the apex and the focus and extending through the focus of the parabola.

According to the invention, moreover, the light source is mounted so that it is shiftable in translation relative to the focus and, more specifically in that plane, or is positioned in a relatively shifted location in translation from the focus or at an offset from the focus. That plane, where it intersects the parabola of the reflector can define a circle and the area within that circle can, in turn, be defined as the lumen of the fixture. The reflected light can therefore emerge from the reflector through this lumen, having reflected only from the portion of the reflector between this circle and the apex.

The invention permits a very shallow parabola to be used, i.e. permits the parabolic reflector to be axially shortened by comparison with earlier systems since the parabola needs only extend between its apex and the aforementioned plane so that it, in its axial depth, only corresponds to the spacing between the focus and the apex. The parabola can have an axis of symmetry which is perpendicular to the lumen plane as previously defined and can correspond to the parabola axis mentioned previously.

The parabolic reflector itself can be shortened to terminate at that plane or any part of the reflector structure extending beyond that plane away from the apex can be utilized for other purposes than light delivery, i.e. for mounting the fixture or the reflector or for receiving additional lenses, light-configuring structures, filters or the like, or for mounting the latter in the floor, wall or ceiling. At the light delivery side of the fixture, a window can be provided which can also be mounted on a portion of the reflector beyond the aforementioned lumen plane.

The parabolic reflector of the invention will naturally have a narrower field through which the light emerges than a parabolic reflector which has not been similarly axially shortened but can have a correspondingly greater light flux density across the lumen.

Because the light source is shiftable in translation in the aforementioned plane, the invention affords the possibility of so deflecting the parallel light rays emerging from the fixture that they need not be parallel to the axis of symmetry but rather can emerge at an angle of inclination to the symmetry axis of the parabolic reflector.

In the case of in the floor reflector light fixtures, therefore, it is possible simply by translating the position of the lamp in the aforementioned plane to avoid the blinding phenomenon by causing the light rays to emerge angled toward a wall which can be, for example, at a right angle to the floor and the aforementioned lumen plane.

The same principle can apply to in the wall reflector lighting or reflector lighting which is located above the region to be illuminated and indeed whenever planar surfaces, for example roadways, street areas, entry ways or the like are to be illuminated in a manner free from blinding. It is for example possible to provide reflector lighting according to the invention in entry ways of garages or other traveled ways, especially as in the wall lighting, in which the light outlet plane is vertical and can be located substantially at the level of the lights of the vehicle and thereby to so illuminate the traveled way that the driver is not blinded even when the lamps are directly within the view of the driver.

In any case, direct blinding by the light source of the light fixtures of the invention can be avoided by ensuring that the light emitted by the light source is only delivered by the reflector between the apex and the aforementioned ring and only within the lumen plane. According to a further feature of the invention, the light source can be releasably arrested in any optional position within its translation only. In that case, a multiplicity of in the floor reflector fixtures can be used for uniform wall lighting in spite of significant deviations in the tolerances with which the fixtures are located in the floor. In that case the individual adjustment of the reflector fixtures allows the light to be distributed uniformly along the wall.

According to another feature of the invention, the light source is adjustable along a street light which can be horizontal or vertical and can be perpendicular, where appropriate, to the wall surface to be illuminated. A shifting of the light source away from the wall surface to be illuminated ensures a greater inclination of the light to the wall surface. Naturally, a shift of the lamp in the direction of the wall surface to be illuminated reduces the inclination of the light rays directed at the wall surface.

In order to ensure that the light rays will only emerge between the intersection of the lumen plane and the reflector on the one hand and the apex of the reflector on the other, the light source on its side turned away from the reflector can be covered by an opaque coating or cover (shield). The shield can be curved and can be hemispherical or semicylindrical, depending upon the shape of the light source.

To avoid undesired light reflection, it has been found to be advantageous to locate the free edges of the shield substantially in the lumen plane.

To avoid multiple reflections and thermal effects, the inner surface of the shielding turned toward the light source is preferably of a matte finish or has blackened and most advantageously has a blackened matte finish.

It has been found to be advantageous, especially in the context of the use of the opaque shield of the present invention to employ a light source which radiates in substantially all directions. Preferred light sources are low voltage halogen lamps, for example type QT 12 halogen lamps or halogen metal vapor systematic lamps of the type HIT-CRI 35 with such light sources which can be either circularly cylindrical or generally spherical, the light source can have a lamp bulb which has a cylinder axis substantially in the lumen plane while the opaque shielding at least indirectly is laterally mounted on the reflector and engages partly around the lamp.

The opaque shielding can be at least indirectly secured at one end or at both ends to the reflector. To avoid light losses, it has been found to be advantageous to mount the opaque shielding at least indirectly at only one end laterally on the reflector. The light source can be shifted with its shielding or mounting bracket or relative to its shielding and/or mounting bracket. In the latter case the shielding should be sufficiently large, e.g. larger than the light source, to allow shifting. This ensures that direct blinding cannot occur during the shifting of the light source.

According to a further feature of the invention, a light source can be used which does not have a separate opaque shielding, but rather is so constructed that it is light emissive only on one side. Such light sources are for example LEDs. In that case another feature of the invention is that the light source consists of at least one light-emitting diode.

One side emitting LEDs, whose emissions are directed to the interior of the reflector, require no special opaque shielding.

In the case in which the light emitting diode is of spherical configuration, e.g. hemispherical, the light source may be provided with a separate opaque shielding.

So that there is sufficient light power, the system of the invention can provide that a multiplicity of light emitting diodes can be provided in a tightly packed relationship or along straight lines or curves.

For the displacement of the light source according to the invention, the entire assembly of light emitting diodes can be moved as has been described or the particular point which the light is emitted can be moved by turning on and off one or more light emitting diodes arranged along a straight line or curve.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
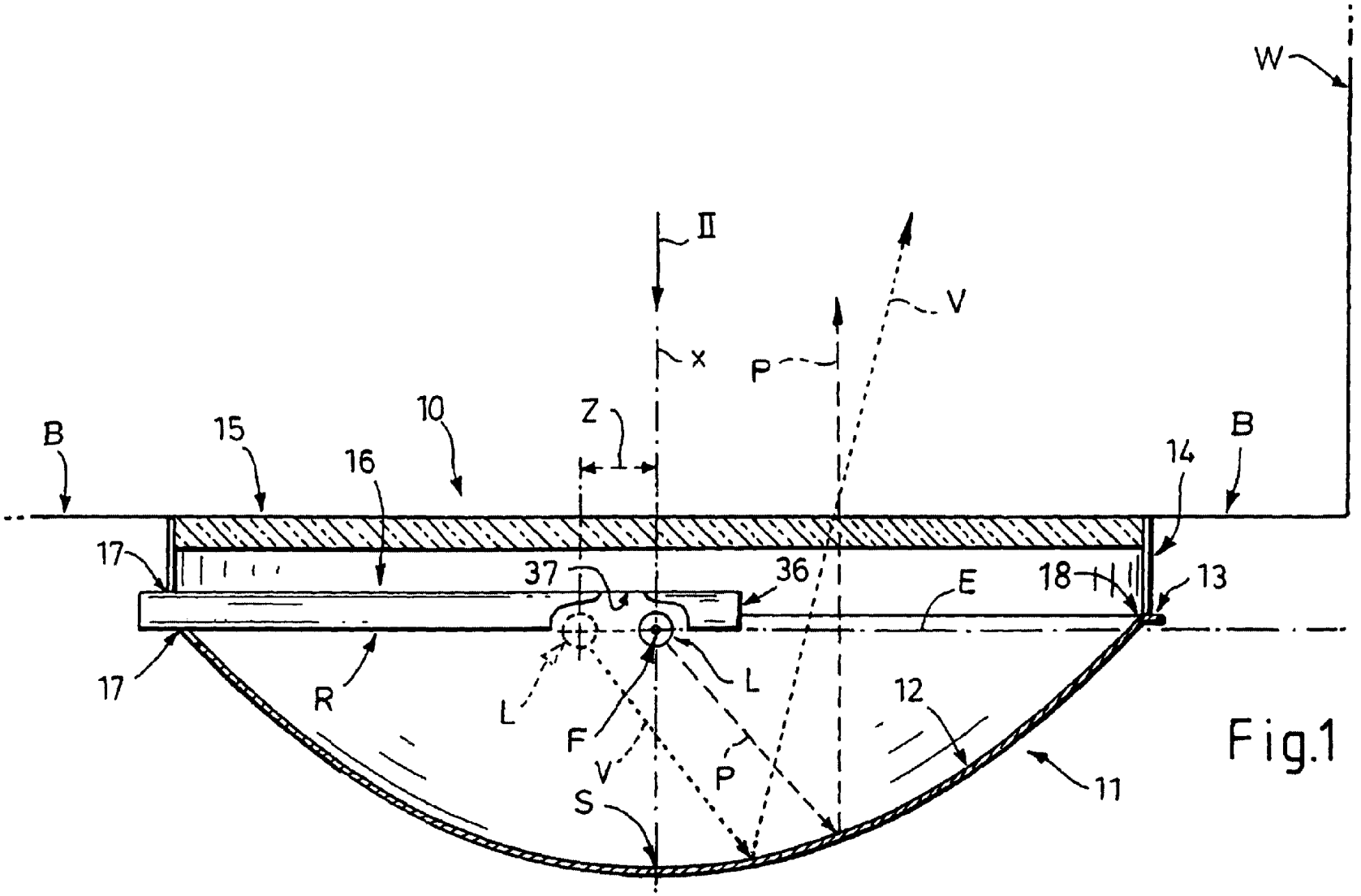
FIG. 1 is a schematic axial cross sectional view through a parabolic reflector light fixture as a floor lamp in an in the floor configuration.
Figure 1A:
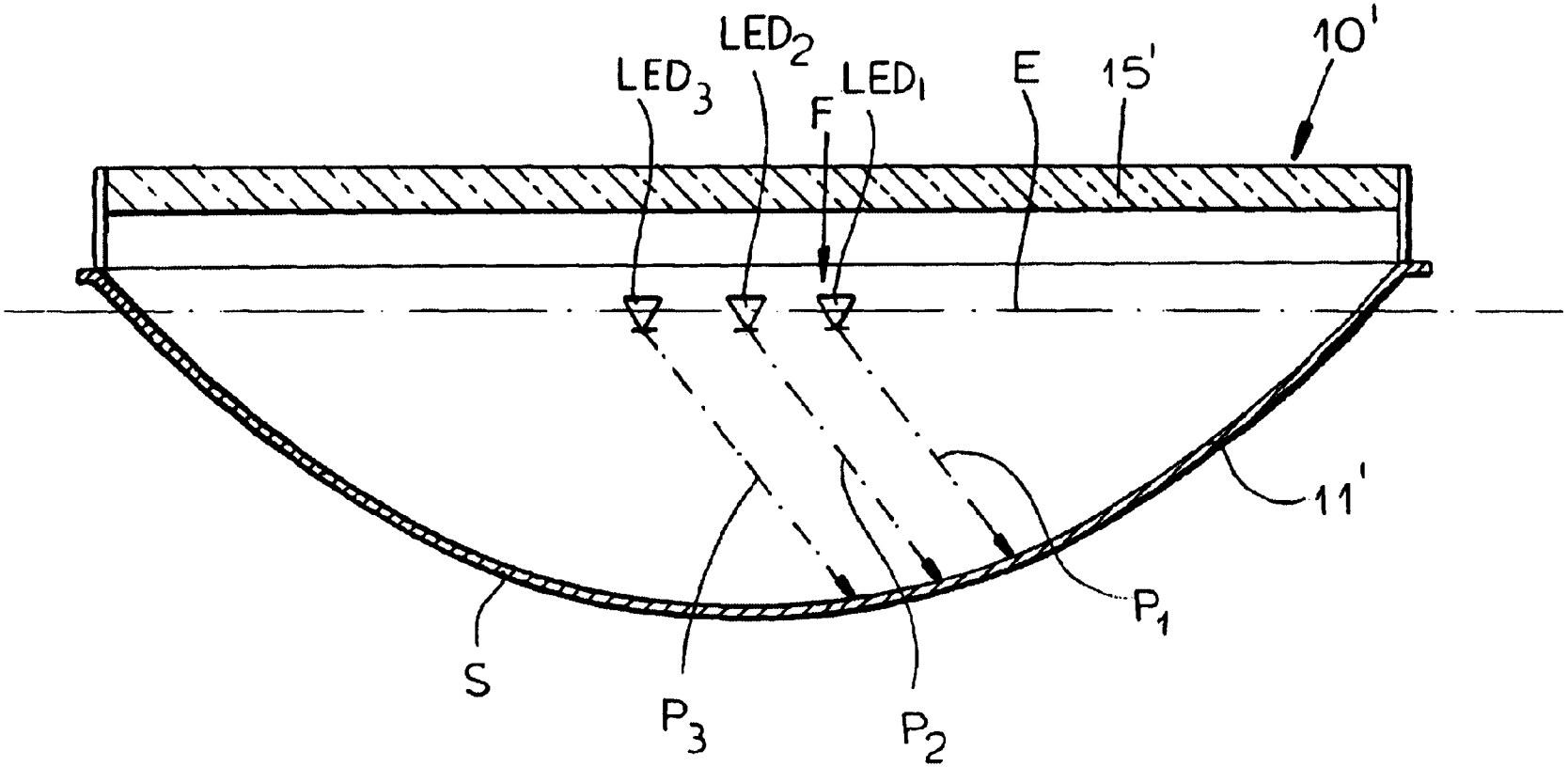
FIG. 1A is a view similar to FIG. 1 of another embodiment.

In the drawing, the reference numeral 10 has been used to refer to the reflector fixture generally and independently of its type of construction or use. Similarly, other reference numerals are used to designate parts in the several Figures which have similar functionality. They may differ to a certain extent structurally.

Figure 2:
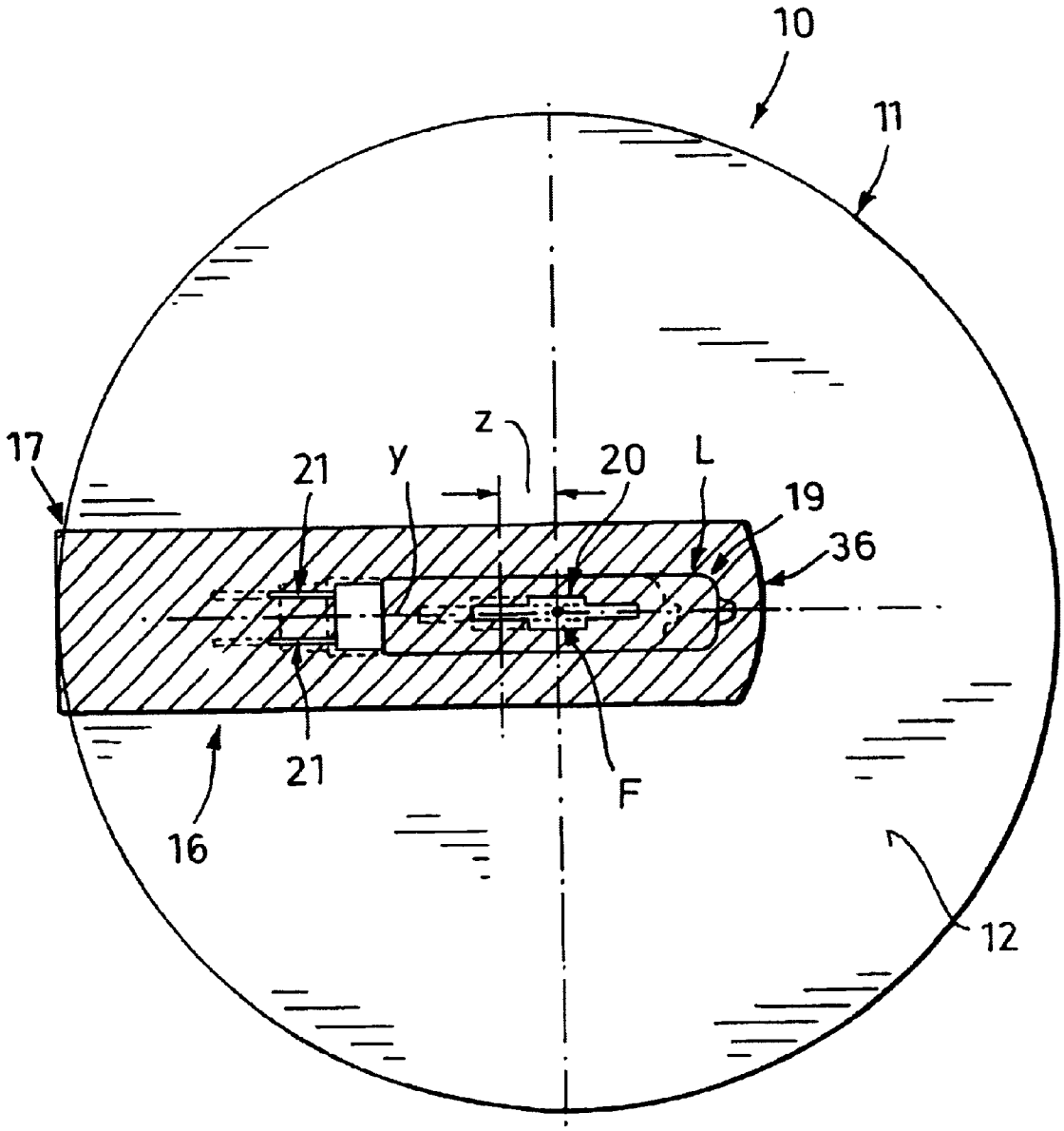
FIG. 2 is a view in the direction of light II in FIG. 1 for the in the floor reflector fixture in a somewhat diagrammatic form.

In FIGS. 1 and 2 an in the floor reflector lighting fixture 10 has been shown. The floor as a whole has been represented at B and adjacent the floor is a vertical wall W (FIG. 1).

The important components of the light fixture 10 are its parabolic reflector 11 which has a mirror-finish inner surface 12. Preferably this inner surface has a high degree of brightness and is uniform, but it also can be structured, for example faceted, for the purposes of the present invention.

The parabolic reflector 11 has a flange 13 to which a cylindrical housing 14 can be affixed and within this housing 14, a transparent glass plate 15 can be provided. The entire assembly can be such that the glass plate can be flush with the floor B and can carry the load normally applied to the floor, i.e. can be walked on or can support any other load for which the floor is designed to support.

Between the reflector 12 and the glass plate 15 and preferably between the flange 13 and the glass plate 15 other glass plate elements can be provided, for example, a prism plate, a sculptured glass lens or a plate forming a color filter or receiving a color filter. The focus of the parabolic reflector 11 is represented at F and the parabolic reflector has an axis of symmetry x which extends through the focus F and the apex S of the reflector 11. At the focus F and as represented in solid lines is a light source which can be a low voltage halogen lamp of the type QT 12 and has been designated at L. An axis of this lamp can lie in a plane E which is also the lumen plane to be described in greater detail below.

A circle shown in broken lines at L' represents another position of the lamp L resulting from its displacement along a path z shown in FIG. 2 and away from the wall W (FIG. 1) and the focus F.

In this case, the light source L is partly enclosed within an opaque elongated shield 16 which can have for example a substantially semicircular cross section and can pass through the parabolic reflector 11 and the housing 14 through a lateral opening 17 therein. At the right hand end of the shield 16, it is closed by a head plate 36.

To make the light source L more visible in FIG. 1, the shield 16 has been broken away at its free end. The inner surface of the shield, represented at 37 in FIG. 1 and the surface facing the lamp and, of course, the interior of the parabolic reflector 11 is matte black.

The opaque shield 16 ensures that the light emitted at the light source 11 will only be directed in paths like those represented by the dashed line P or the dotted line V, to the reflective surface 12 of the parabolic reflector 11 between the light outlet or lumen plane E and the apex S of the reflector 11.

The free edges R of the shield 16 which is of semicircular cross section and is a semicylinder, lie in the plane E. The reflective surface 12 itself ends at the lumen plane E. Any portion of the reflector, represented at 18, which extends beyond the plane E, is not effective in reflecting light outwardly. The reflected light outwardly emerges perpendicular to the plane E (see the light ray P in dashed lines) or at an inclination to the vertical (dotted line V).

As soon as the light source L is moved from its solid line position into, for example, its broken line position at L' away from the focus F, the light rays are so deflected from the vertical that they are inclined at an angle through the wall W. This ensures that one walking on the floor will not be blinded by the light from the lamp. The avoidance of such blinding can be further improved by providing on the left side above the shield 16 and below the glass plate 15 a further light screen which is opaque, flat and segment-shaped like the light screen 34 in FIG. 3.

From FIG. 1 it is also apparent that, instead of two positions for the light source L as shown in solid and broken lines respectively, two or more light emitting diodes (LEDs) can be provided along a straight line parallel to the path of movement or a multiplicity of such LEDs can be provided in the lumen plane so that the LEDs can be turned off or on to effectively shift the location of light emission along the lumen plane E. This eliminates the need for mechanical movement of the lamps. The same advantages are obtained with respect to freedom from blinding if the light emission point is shifted by turning on and off the LEDs as is obtained for the embodiment of FIGS. 1 and 2.

The apparatus can be used in an in the wall system and thus if the plane B is a wall plane and W represents the floor, the lamp can be provided as an in the wall lamp capable of illuminating the space above the floor.

FIG. 2 schematically shows the lamp L in outline and in this Figure the lamp can be seen to have a bulb 19, a burner 20 and pins 21 engaged in a socket. The cylinder axis Y of the glass light bulb 19 lies in the lumen plane E.

Figure 3:
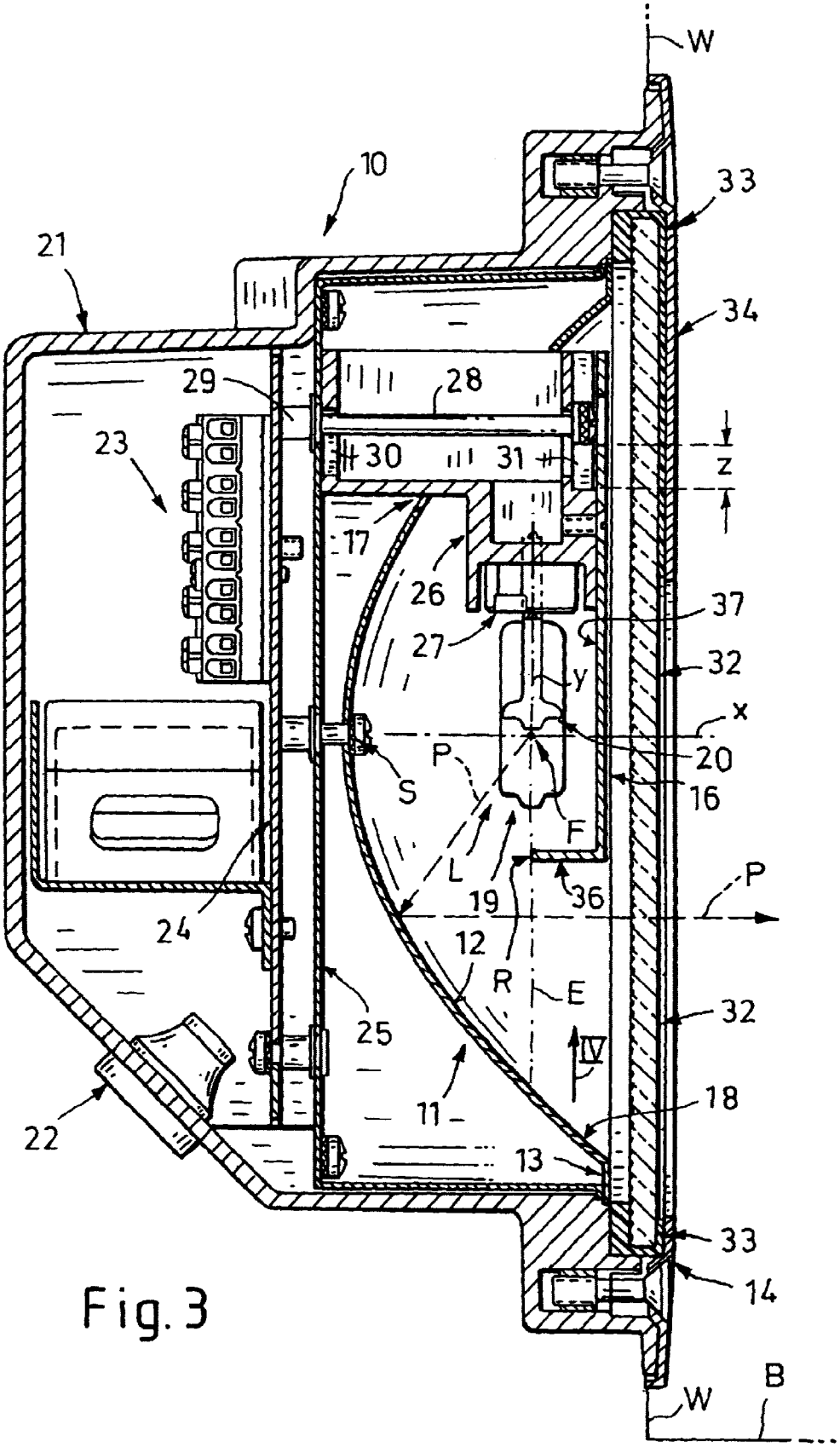
FIG. 3 is an axial vertical section through an in the wall fixture according to the invention.
Figure 4:
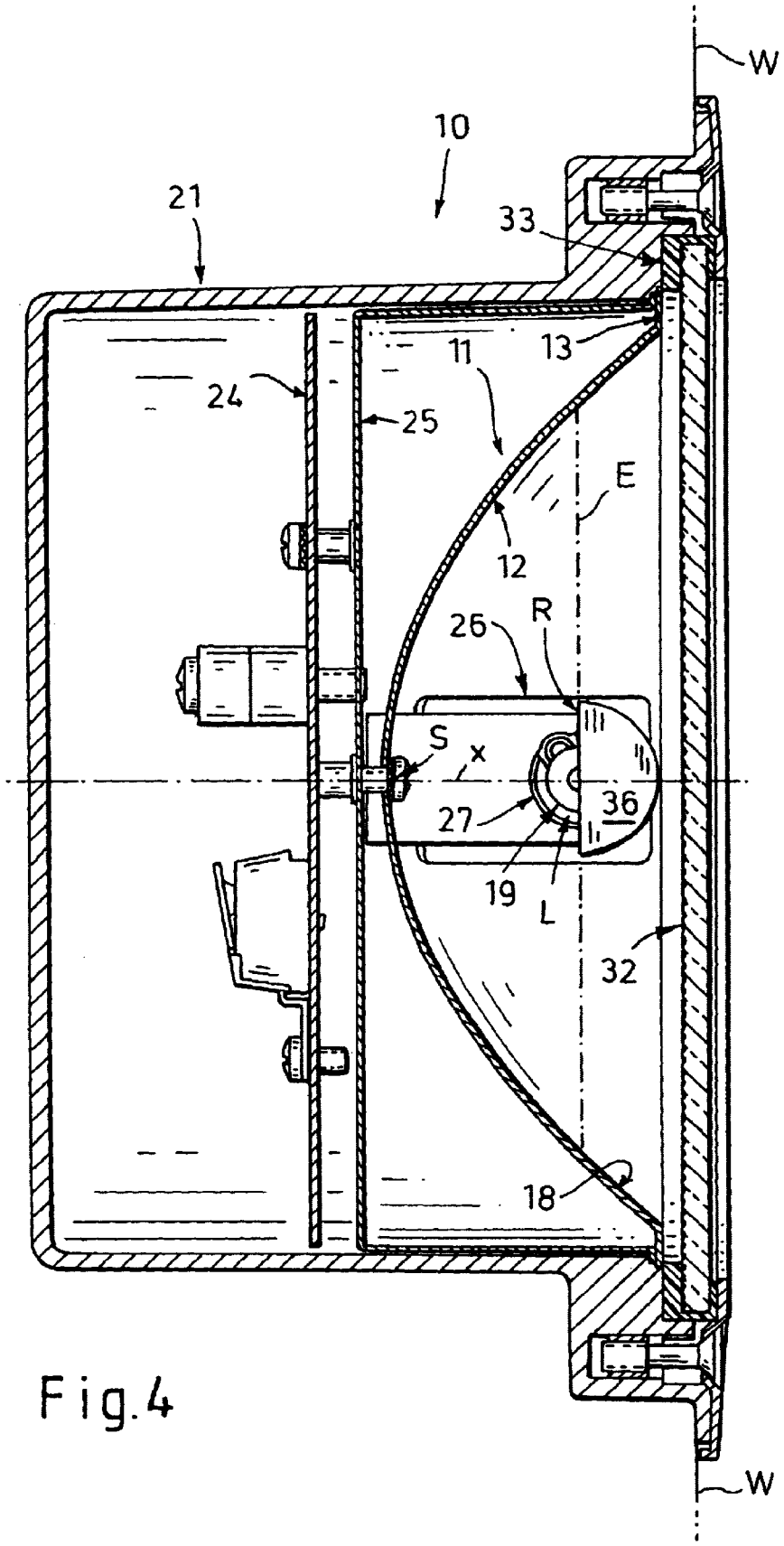
FIG. 4 is a view similar to FIG. 3 but rotated through 90° from that of FIG. 3 and with certain parts shown in elevation.
Figure 5:
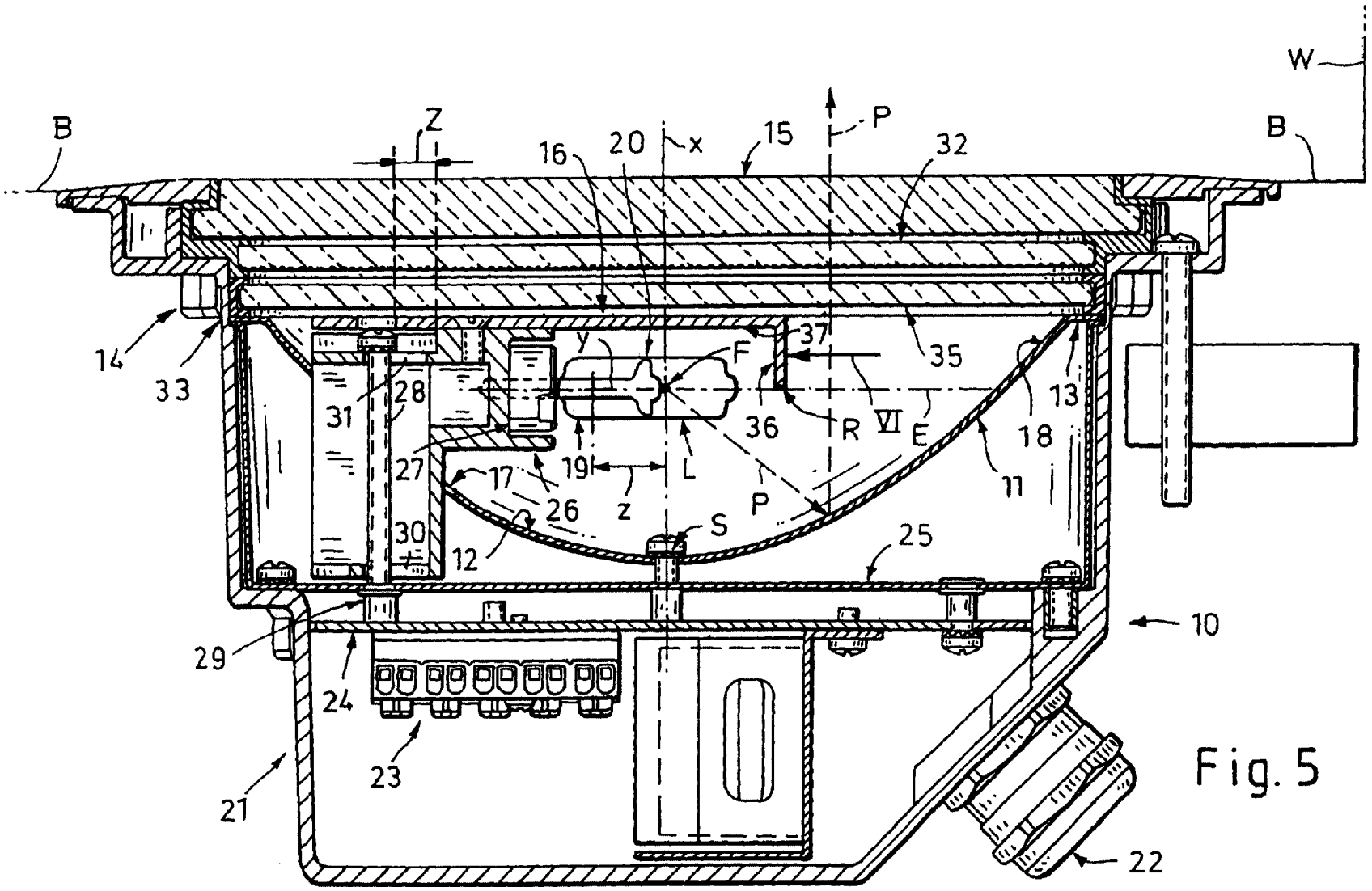
FIG. 5 is an axial vertical section through another in the floor reflector fixture according to the invention.
Figure 6:
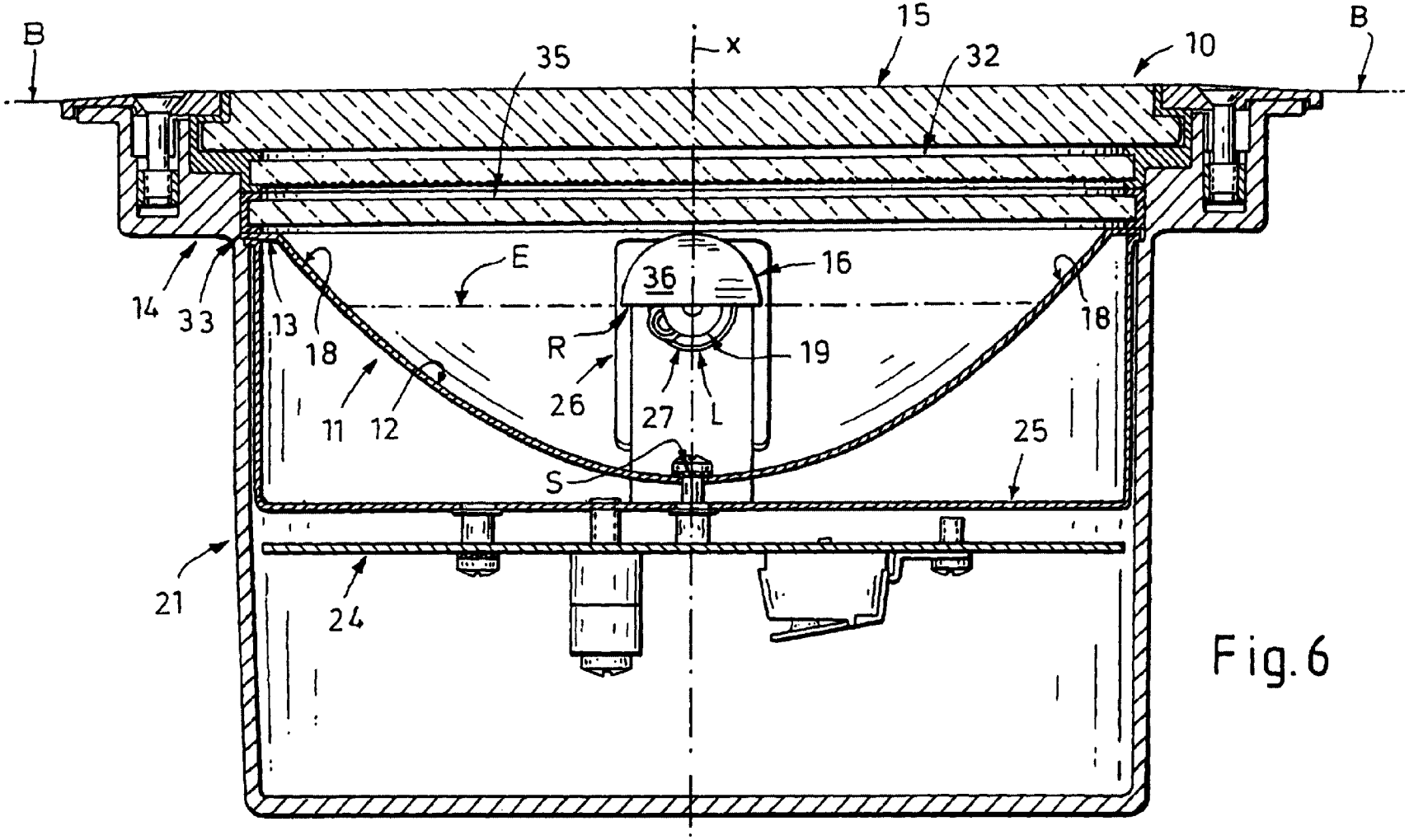
FIG. 6 is a section through the fixture of FIG. 5 with the section plane rotated through 45° about the vertical axis.

FIGS. 3–6 show similar lamp fixtures for an in the wall lamp (FIGS. 3 and 4) and in the floor lamp (FIGS. 5 and 6). The fixture 10 shown in FIGS. 3 and 4 has a stable housing 21 which can be formed by die cast metal or an appropriate plastic and has a cable feed through represented at 22, an electrical terminal block 23 and a mounting plate 24 for holding a cup-shaped inner housing 25 to which the parabolic reflector 11 is attached at its apex S.

The light source shown in FIG. 3 is located at the focal point. As a result the light rays are emitted parallel to one another, orthogonally to the cover plate and parallel to the axis x of the parabola. The floor B is shown below the wall W. When the lamp is shifted, the outgoing light rays can be inclined downwardly toward the floor B.

The fixture includes a lamp carrier in the form of a bracket 26 upon which an opaque shield 16 is also mounted for movement with the bracket 26 and the lamp as a unit. The lamp carrier serves as the socket or base support 27 for the lamp L.

When one releases the clamping screw 28, which is threaded into a bushing 29 on the mounting plate 24, the lamp carrier 26 is sufficiently loose to enable it to be shifted along its adjustment slits 30 and 31 by the distance Z upwardly, thereby causing the downward deflection of the light rays toward the floor B.

Outside the reflector 11, the fixture 10 in FIGS. 3 and 4 is formed with a sculptured lens 32 which serves to scatter the light transmitted by the parabolic reflector 11. The sculpturing lens 32 is surrounded by a seal 33 which is set into the casing 21 to abut the housing 25 and to serve as a support for a segmental light blocking element 34 which is opaque. The seal 33 can be extended for this purpose as shown in the upper part of FIG. 3.

FIG. 4 shows the fixture 10 of FIG. 3 in a cross section rotated by 90° from that of FIG. 3 and in the direction of the arrow IV, i.e. looking to the free end of the shield 37 and its end wall 36.

In FIGS. 5 and 6 I show an in the floor lighting fixture which differs from the fixture of FIGS. 3 and 4 only in that an additional color filter glass plate 35 is provided below the sculpturing lens 32 and a further glass plate 15 is provided above the sculpturing lens 32 flush with the floor B, the latter glass plate 15 being a supporting structure capable of being walked upon.

In FIG. 5 the light source L is shown in the focal point so that the light rays P emerge from the lumen plane E orthogonally thereto. From FIG. 5, moreover, it will be apparent that the lamp can be shifted, e.g. to the left, upon loosening of the clamping screw 28 so that the entire lamp carrier can be displaced by the distance Z to the left. This displacement of the lamp away from the focal point P and the wall W can redirect the light rays so they emerge at an angle toward the wall W from the lumen plane as shown in the light rays V of FIG. 1.

FIG. 6 is a cross sectional view rotated through 90° from the view in FIG. 5 and taken in the direction of arrow VI of FIG. 5 toward the plate 36 of the shield 16.

I claim:

1. A reflector lighting fixture for use as an in-the-floor, an in-the-wall and an in-the-ceiling fixture which comprises:

a parabolic reflector having an apex, a focus and a symmetry axis passing through the focus and intersecting said reflector at the apex, said parabolic reflector emitting light at a lumen plane perpendicular to said axis, passing through said focus and only from portions of said reflector between said apex and said lumen plane;

a light source in said reflector training light onto said reflector for producing the light reflected from said reflector and emitted at said lumen plane; and a mount for said light source enabling shifting of the light source in translation in said lumen plane relative to said focus or positioning of said light source at a location in said lumen plane offset in translation from said focus.

2. The reflector lighting fixture defined in claim 1, further comprising means for securing said light source enabling releasable securing of said light source at any shifted position thereof relative to said focus in said lumen plane.

3. The reflector lighting fixture defined in claim 1 wherein said light source is shiftable along a straight line.

4. A reflector lighting fixture for use as an in-the-floor, an in-the-wall and an in-the-ceiling fixture which comprises:

a parabolic reflector having an apex, a focus, a symmetry axis passing through the focus and intersecting said reflector at the apex and emitting light at a lumen plane perpendicular to said axis, passing through said focus and only from portions of said reflector between said apex and said lumen plane;

a light source in said reflector training light onto said reflector for producing the light reflected from said reflector and emitted at said lumen plane;

a mount for said light source enabling shifting of the light source in translation in said lumen plane relative to said focus or positioning of said light source at a location in said lumen plane offset in translation from said focus, and a light-impermeable shield along a side of said lamp turned away from said apex.

5. The reflector lighting fixture defined in claim 4 wherein said shield has a hemispherical or semicylindrical curvature.

6. The reflector lighting fixture defined in claim 4 wherein said shield has free edges lying substantially in said lumen plane.

7. The reflector lighting fixture defined in claim 4 which has a side turned toward said lamp, said side being of a matte finish or blackened.

8. The reflector lighting fixture defined in claim 4 wherein said light source is constructed and arranged to radiate in substantially all directions.

9. A reflector lighting fixture for use as an in-the-floor, an in-the-wall and an in-the-ceiling fixture which comprises:

a parabolic reflector having an apex, a focus a symmetry axis passing through the focus and intersecting said reflector at the apex, said parabolic reflector emitting light at a lumen plane perpendicular to said axis, passing through said focus and only from portions of said reflector between said apex and said lumen plane;

a light source in said reflector training light onto said reflector for producing the light reflected from said reflector and emitted at said lumen plane;

a mount for said light source enabling shifting of the light source in translation relative to said focus or positioning said light source at a location offset in translation from said focus, said light source being a light bulb of substantially circularly cylindrical shape, said bulb having a cylinder axis lying substantially in said lumen plane, and a light-impermeable shield for said light bulb extending along a side thereof turned away from said reflector and being at least indirectly secured laterally to the reflector.

10. The reflector lighting fixture defined in claim 9 wherein said shield is mounted at least indirectly at one end on said reflector.

11. The reflector lighting fixture defined in claim 4 wherein the light source and said shield are shiftable linearly relative to said reflector.

12. The reflector lighting fixture defined in claim 11 wherein the shield is larger than said light source to permit shifting of said light source relative to said reflector.

13. The reflector lighting fixture defined in claim 1, further comprising a transparent cover plate covering the open side of said reflector and a side of said light source turned away from said reflector.

14. The reflector lighting fixture defined in claim 1, further comprising a transparent and generally planar sculptured lens plate covering an open side of said reflector and a side of said light source turned away from said reflector.

15. The reflector lighting fixture defined in claim 14 wherein prisms of said sculptured lens plate are turned toward said open side of said reflector.

16. The reflector lighting fixture defined in claim 15 wherein prisms are formed as linearly extending ribs.

17. The reflector lighting fixture defined in claim 16 wherein said ribs are of triangular or circularly segmental cross section.

18. The reflector lighting fixture defined in claim 16 wherein said ribs have apex lines parallel to a direction of translation of said light source.

19. The reflector lighting fixture defined in claim 1 wherein said light source is comprised of at least one light-emitting diode.

20. The reflector lighting fixture defined in claim 19 wherein a multiplicity of light-emitting diodes, disposed close together form said light source.

21. The reflector lighting fixture defined in claim 20 wherein said light emitting diodes are oriented along a curve or a straight line.

22. The reflector lighting fixture defined in claim 21 wherein said light-emitting diodes are connected for individual energization or energization in groups.

23. The reflector lighting fixture defined in claim 1 wherein said reflector is formed at an open side thereof with a recess for accommodating a holder for a transparent cover plate.

24. The reflector lighting fixture defined in claim 23, further comprising a shield covering a side of said light source turned away from said reflector and extending into at least one recess in said holder.

* * * * *